US007159694B2

(12) United States Patent
Gibson

(10) Patent No.: US 7,159,694 B2
(45) Date of Patent: Jan. 9, 2007

(54) STEP STOOL TRAY

(75) Inventor: William R. Gibson, Kent, OH (US)

(73) Assignee: Cosco Management, Inc., Wilmington, DE (US)

( * ) Notice: Subject to any disclaimer, the term of this patent is extended or adjusted under 35 U.S.C. 154(b) by 281 days.

(21) Appl. No.: 10/866,842

(22) Filed: Jun. 14, 2004

(65) Prior Publication Data

US 2005/0274575 A1 Dec. 15, 2005

(51) Int. Cl.
*E06C 1/00* (2006.01)

(52) U.S. Cl. ..... 182/165; 182/165; 182/161; 182/129

(58) Field of Classification Search ..... 182/165, 182/129, 161; D7/553.1; 248/210, 238
See application file for complete search history.

(56) References Cited

U.S. PATENT DOCUMENTS 2,308,180 A * 1/1943 Larsen et al. ..... 248/238
D189,419 S * 12/1960 Bair ..... D25/64
5,052,581 A * 10/1991 Christ et al. ..... 220/570
5,636,817 A * 6/1997 Beachy ..... 248/210
5,673,885 A * 10/1997 Pham ..... 248/210
5,722,507 A * 3/1998 Kain ..... 182/129
5,950,972 A * 9/1999 Irish ..... 248/210
D449,385 S * 10/2001 Rosko ..... D25/64
6,427,805 B1 * 8/2002 Gibson et al. ..... 182/165
D465,289 S * 11/2002 Gibson et al. ..... D25/64
D466,225 S * 11/2002 Rosko ..... D25/64
6,902,034 B1 * 6/2005 Gibson et al. ..... 182/129
2004/0231920 A1 * 11/2004 Meeker ..... 182/165

* cited by examiner

*Primary Examiner*—Richard E. Chilcot, Jr.
*Assistant Examiner*—Lindsay M. Maguire
(74) *Attorney, Agent, or Firm*—Barnes & Thornburg LLP

(57) ABSTRACT

A step stool includes a frame and a tray coupled to the frame. The tray includes a pair of container receivers. Each container receiver is adapted to receive a container on the container receiver.

22 Claims, 11 Drawing Sheets

STEP STOOL TRAY

BACKGROUND

The present disclosure relates to a step stool. More particularly, the present disclosure relates to a step stool including a tray.

SUMMARY

In accordance with the present disclosure, a step stool includes a frame and a tray coupled to the frame. The tray includes a larger container receiver and a smaller container receiver recessed from and surrounded by the larger container receiver. The larger container receiver has a generally square-shaped outer boundary that bounds a larger container recess formed in the larger container receiver adapted to receive a larger container (e.g., a gallon-sized paint container shaped generally as a square cylinder or a circular cylinder). The smaller container receiver has a generally circular outer boundary that bounds a smaller container recess formed in the smaller container receiver and adapted to receive a smaller container (e.g., a quart-sized paint container shaped generally as a circular cylinder).

The larger container receiver includes a square bottom wall and a square side wall that provides the square-shaped outer boundary. Each of the square bottom wall and the square side wall has a generally square shape. The square side wall is coupled to and surrounds the square bottom wall to retain the larger container on the square bottom wall in the larger container recess.

The smaller container receiver includes a circular bottom wall and a circular side wall that provides the circular outer boundary. Each of the circular bottom wall and the circular side wall has a generally circular shape. The circular side wall is coupled to and extends between the circular bottom wall and the square bottom wall and surrounds the circular bottom wall to retain the smaller container on the circular bottom wall in the smaller container recess.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which.

DETAILED DESCRIPTION

Figure 1:
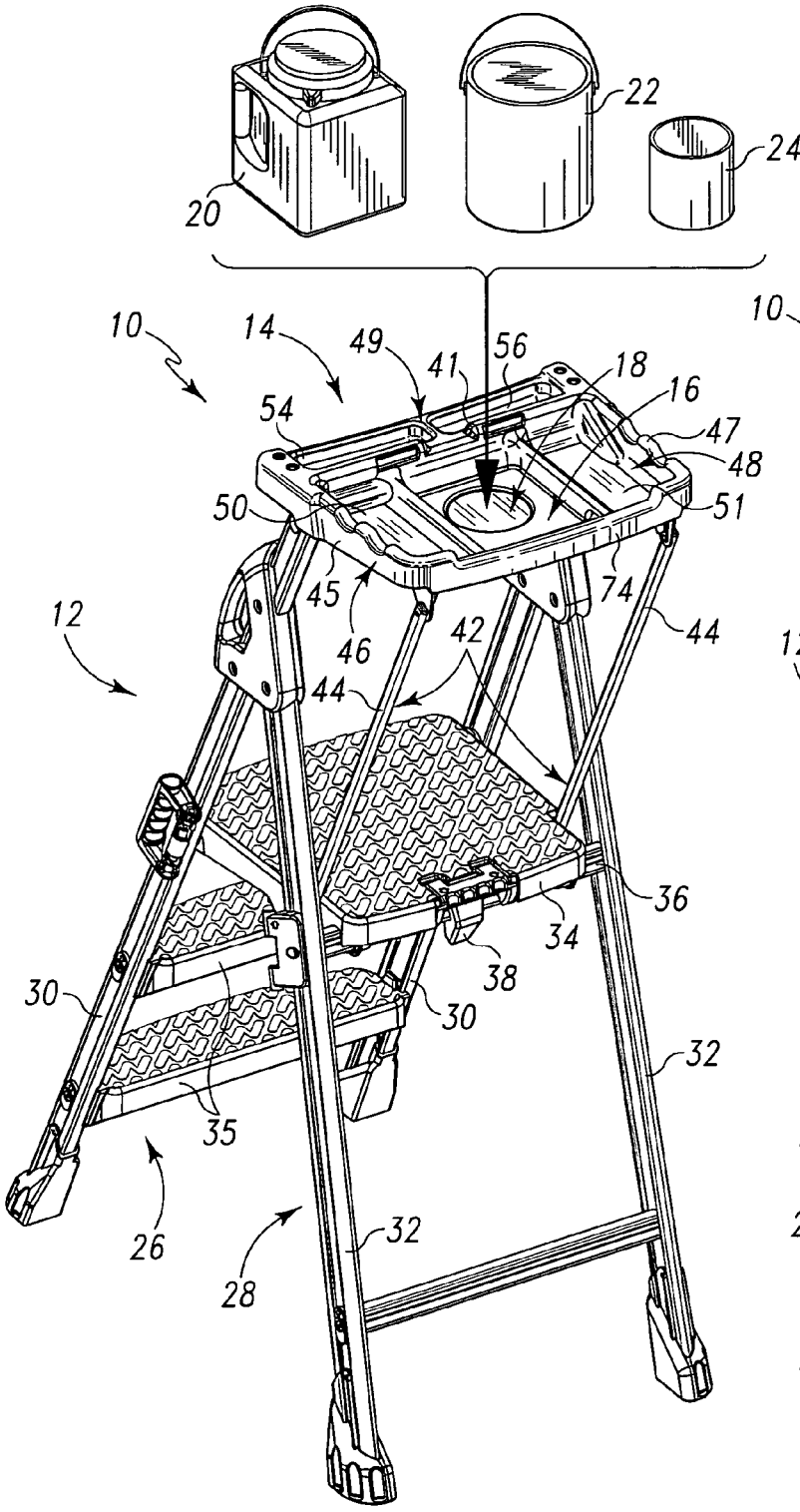
FIG. 1 is a perspective view showing a tray that is included in a step stool and formed to include a generally square-shaped larger container receiver adapted to receive a larger container (e.g., a gallon-sized first paint container shaped generally as a square cylinder, a gallon-sized second paint container shaped generally as a circular cylinder) and a generally circular smaller container receiver recessed from the larger container receiver and adapted to receive a smaller container (e.g., a quart-sized third paint container shaped generally as a circular cylinder)

A step stool 10 includes a frame 12 and a utility tray 14 coupled to frame 12, as shown, for example, in FIG. 1. Tray 14 includes a generally square-shaped larger container receiver 16 and a generally circular smaller container receiver 18 recessed from and surrounded by larger container receiver 16, as shown, for example, in FIG. 3. Larger container receiver 16 is adapted to receive a larger container such as, for example, a gallon-sized first paint container 20 shaped generally as a square cylinder and a gallon-sized second paint container 22 shaped generally as a circular cylinder. Smaller container receiver 18 is adapted to receive a smaller container such as, for example, a quart-sized third paint container 24 shaped generally as a circular cylinder.

Figure 2:
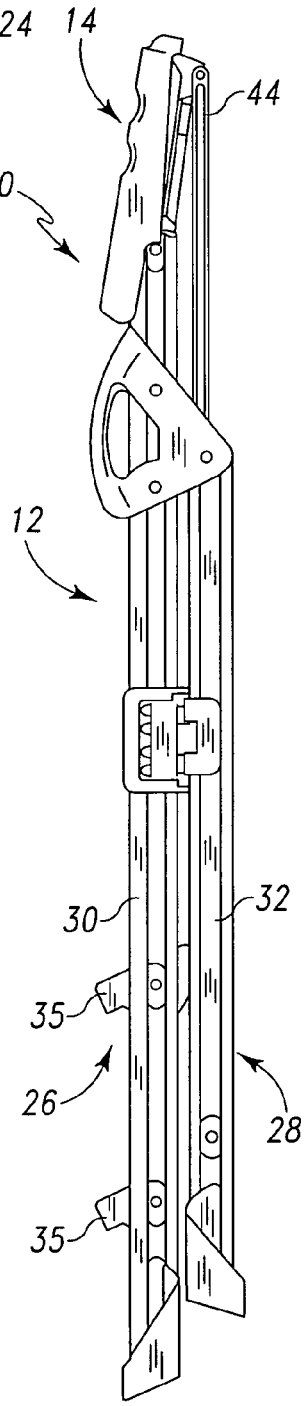
FIG. 2 is a side elevation view showing the step stool in a collapsed position.

Frame 12 includes a front unit 26 and a rear unit 28, as shown, for example, in FIGS. 1 and 2. Left and right front legs 30 of front unit 26 and left and right rear legs 32 of rear unit 28 are coupled to one another for pivotable movement of front and rear units 26, 28 between an opened position shown, for example, in FIG. 1 and a closed position shown, for example, in FIG. 2. A top step 34 located above lower steps 35 is coupled to front legs 30 for pivotable movement relative thereto and to a rear cross member 36 of rear unit 28 through a pivot link (not shown) extending between top step 34 and cross member 36 to pivot front and rear units 26, 28 between the opened and closed positions. A latch 38 is coupled to top step 34 to latch rear cross member 36 to lock front and rear units 26, 28 in the opened position and to unlatch rear cross member 36 to unlock frame 12 for movement between the opened and closed positions.

Figure 4:
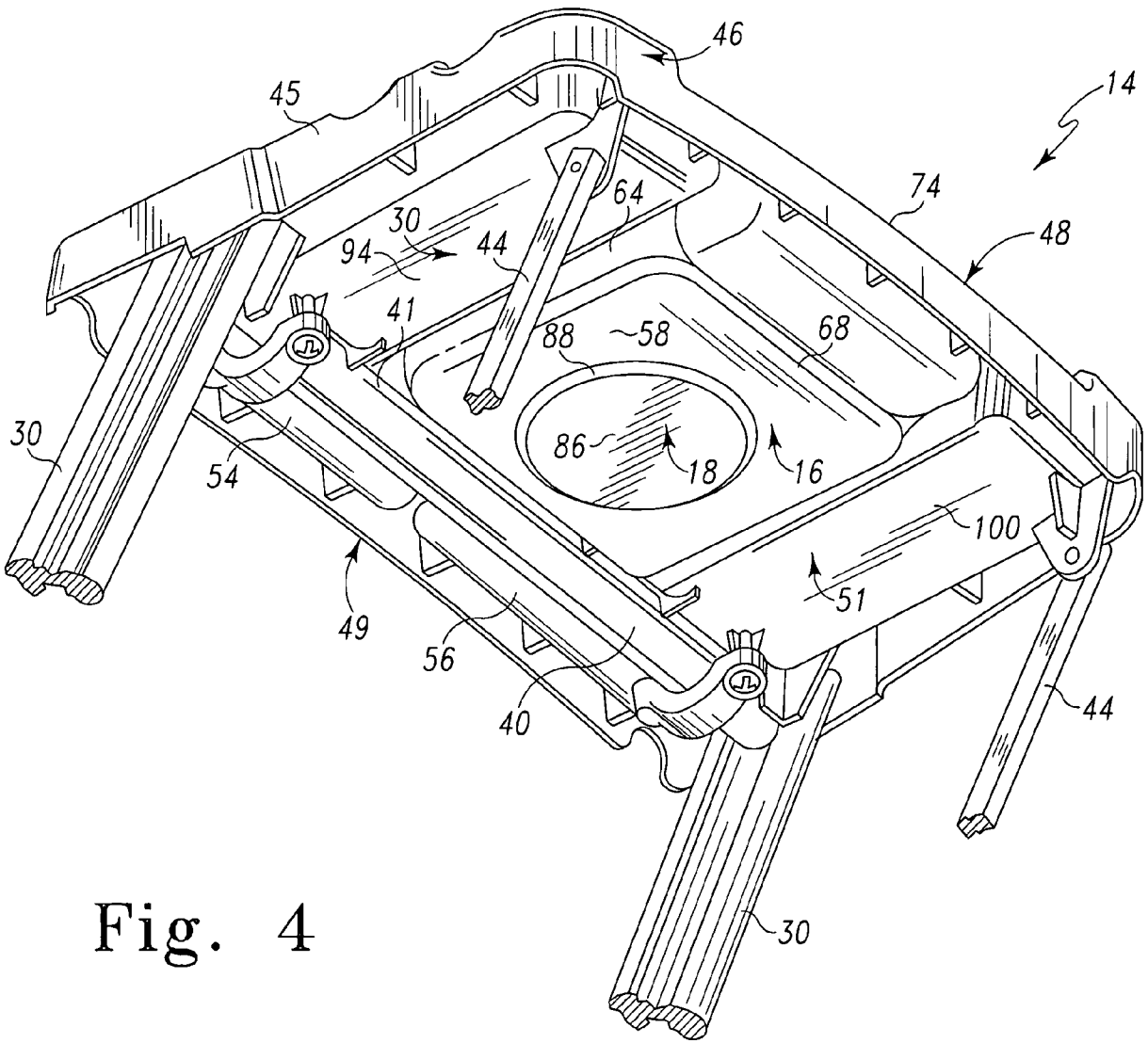
FIG. 4 is a bottom perspective view of the tray.

Tray 14 is coupled to a top cross member 40 connecting left and right front legs 30, as shown, for example, in FIG. 4. Tray 14 includes a first partition 41 that rests on, is coupled to, and pivots on top cross member 40. A tray pivot controller 42 is coupled to tray 14 and top step 34 for pivotable movement of tray 14 between an extended position shown, for example, in FIG. 1 and a retracted position shown, for example, in FIG. 2 upon pivotable movement of top step 34. Tray pivot controller 42 includes left and right links 44 coupled to top step 34 and tray 14 for pivotable movement relative to top step 34 and tray 14.

Figure 5:
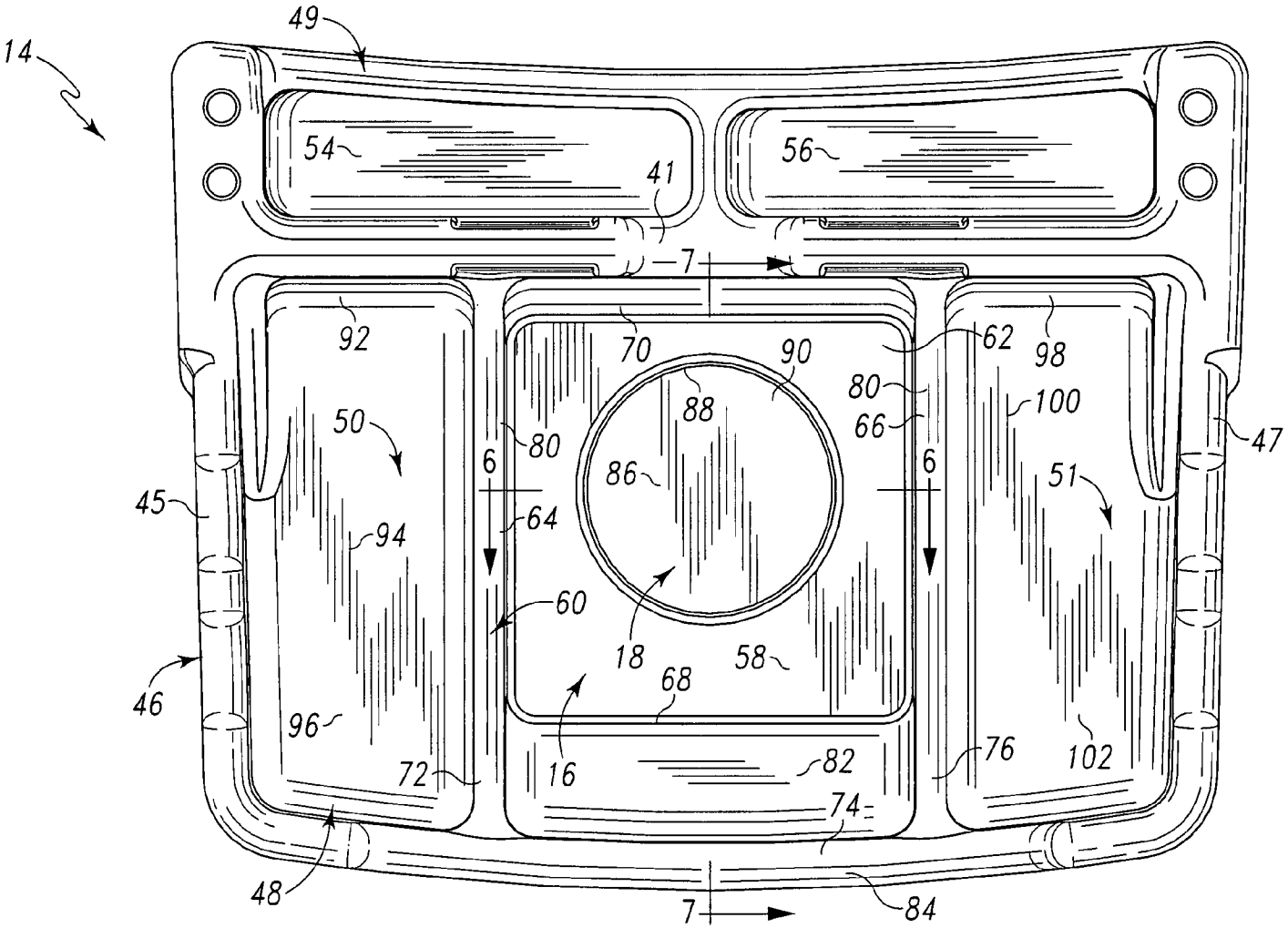
FIG. 5 is a top plan view of the tray showing the smaller container receiver within the larger container receiver.

First partition 41 extends from a first rim side portion 45 of a rim 46 to a second rim side portion 47 of rim 46 to partition tray 14 into a rear portion 48 and a front portion 49, as shown, for example, in FIG. 5. Rear portion 48 includes larger and smaller container receivers 16, 18, and first and second side receivers 50, 51 adapted to receive articles therein. Larger and smaller container receivers 16, 18 are positioned between first and second side receivers 50, 51. Front portion 49 includes first and second front receivers 54, 56 adapted to receive articles therein. First partition 41 includes portions of each of larger container receiver 16, first and second side receivers 50, 51, and first and second front receivers 54, 56.

Figure 8:
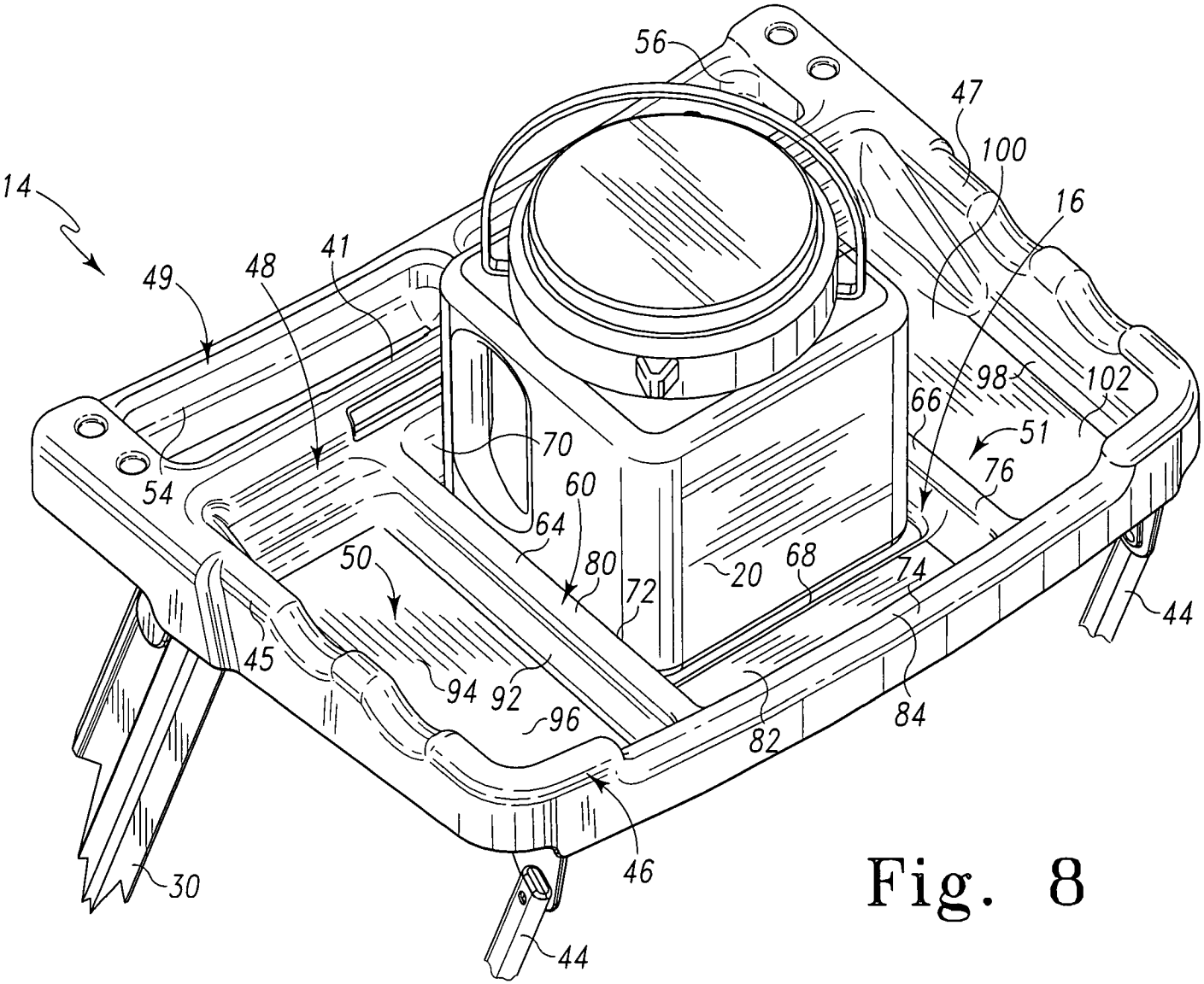
FIG. 8 is a perspective view showing the first paint container received in the larger container receiver.
Figure 9:
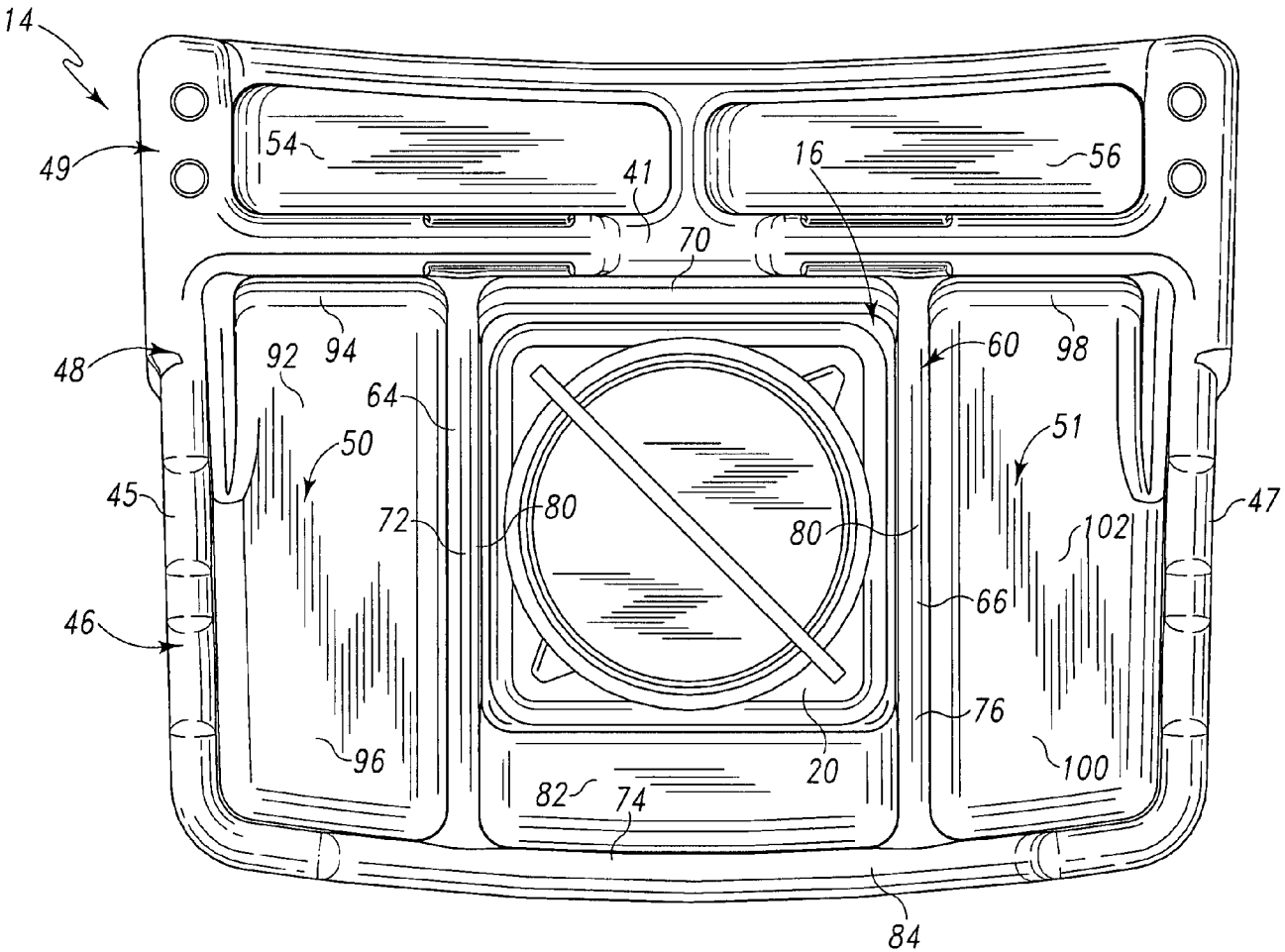
FIG. 9 is a top plan view showing the first paint container received in the larger container receiver.
Figure 10:
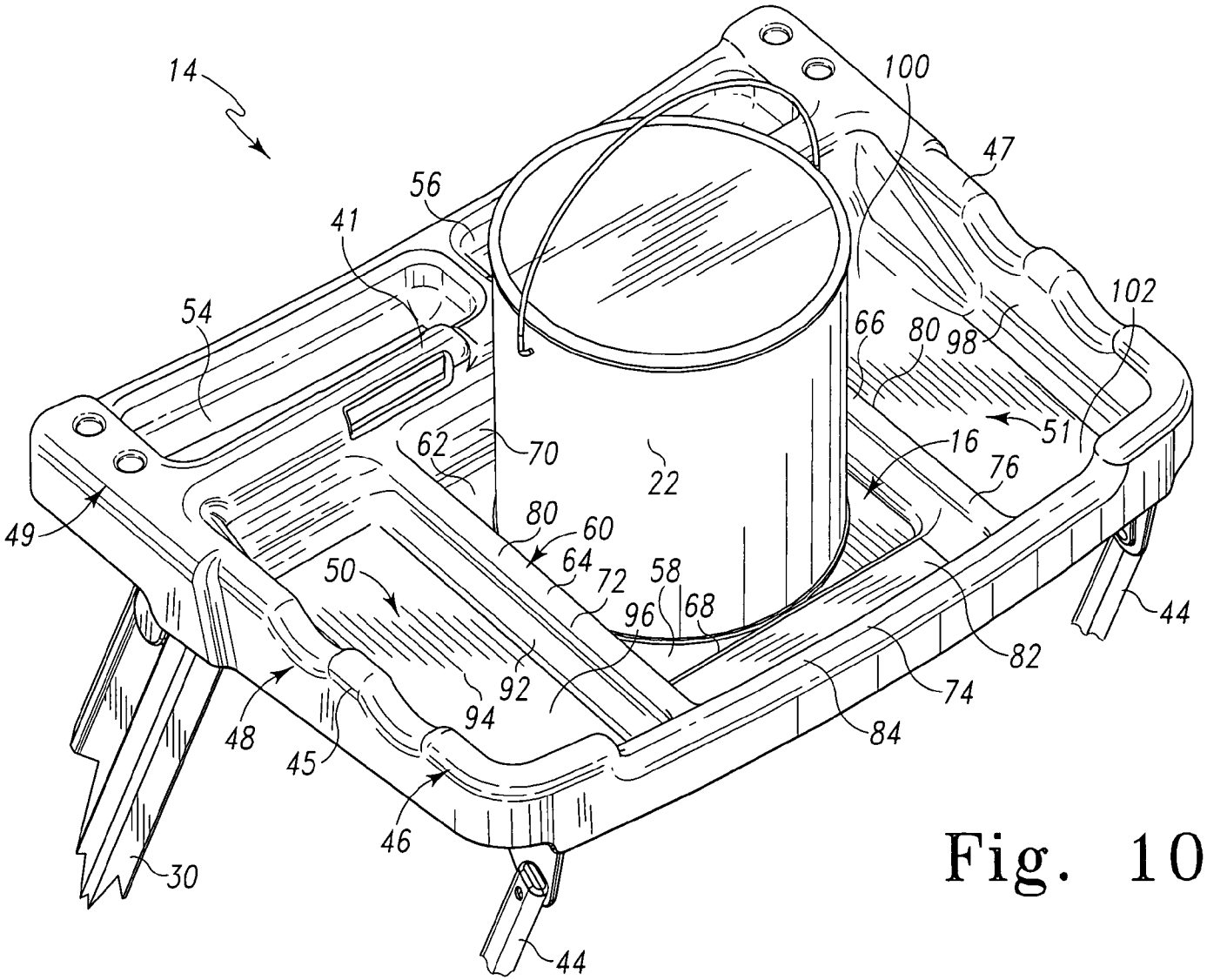
FIG. 10 is a perspective view showing the second paint container received in the larger container receiver.
Figure 11:
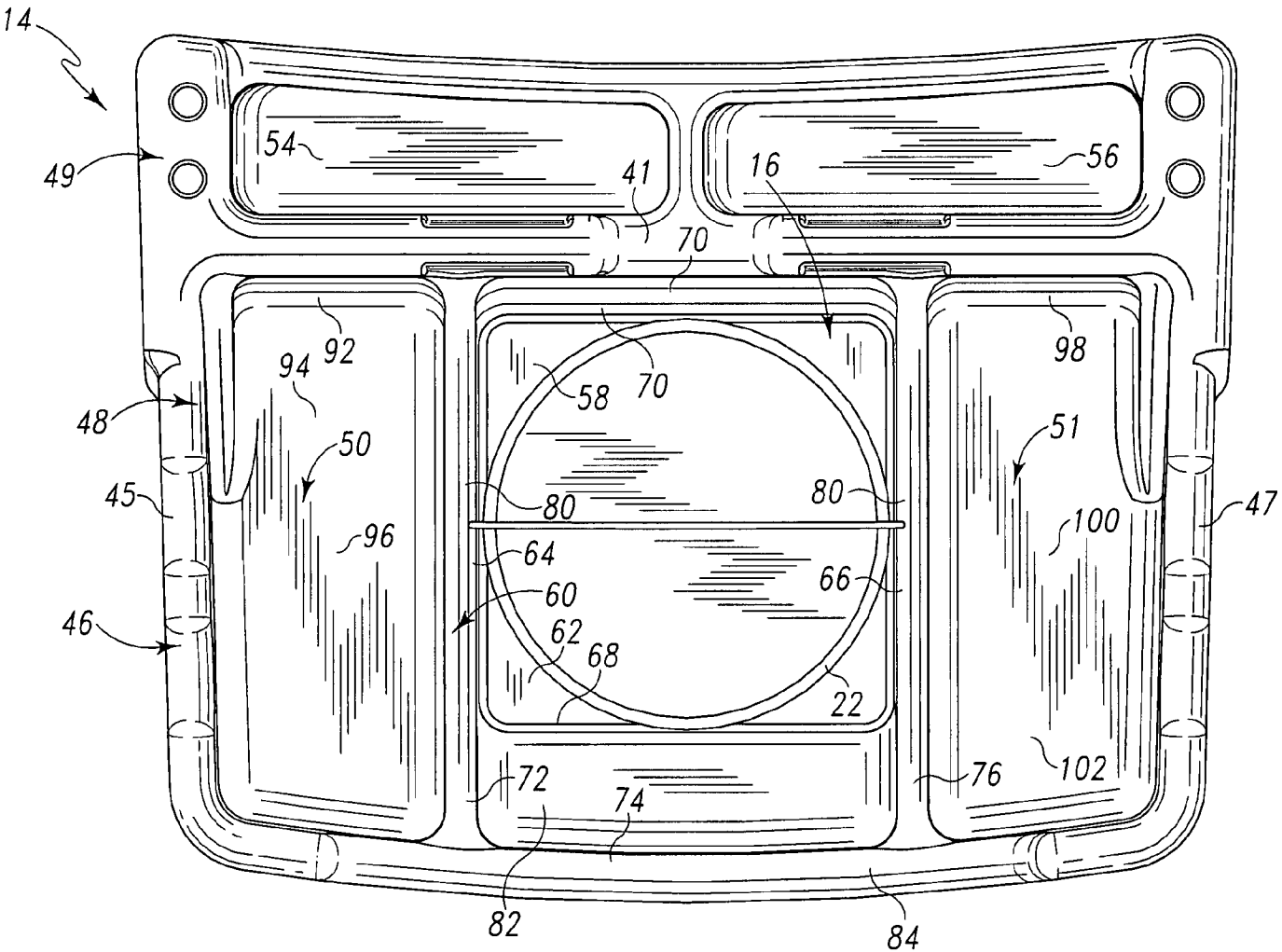
FIG. 11 is a top plan view showing the second paint container received in the larger container receiver.

Larger container receiver 16 includes a square bottom wall 58 and a square side wall 60, as shown, for example, in FIG. 5. Each wall 58, 60 has a generally square shape. Square side wall 60 is coupled to and surrounds square bottom wall 58 to retain a larger container on square bottom wall 58 in a larger container recess 62 provided by square bottom wall 58 and square side wall 60. For example, square side wall 60 is adapted to retain first paint container 20 on square bottom wall 58 when first paint container 20 is positioned in larger container recess 62, as shown, for example, in FIGS. 8 and 9. Square side wall 60 is also adapted to retain second paint container 22 on square bottom wall 58 when second paint container 22 is positioned in larger container recess 62, as shown, for example, in FIGS. 10 and 11. Square side wall 60 provides a generally square outer boundary or perimeter that bounds larger container recess 62.

Square side wall 60 includes a first side wall portion 64, a second side wall portion 66, a third side wall portion 68, and a fourth side wall portion 70, as shown, for example, in FIG. 5. Wall portions 64, 66, 68, 70 are coupled and extend upwardly from square bottom wall 58 when tray 14 is positioned in its extended position.

First and second side wall portions 64, 66 are parallel to one another, as shown, for example, in FIG. 5. First side wall portion 64 is included in a second partition 72 that is included in rear portion 48 of tray 14 and extends from first partition 41 to a rim rear portion 74 of rim 46. Second side wall portion 66 is included in a third partition 76 that is included in rear portion 48 of tray 14 and extends from first partition 41 to rim rear portion 74 in parallel relation to second partition 72.

Figure 6:
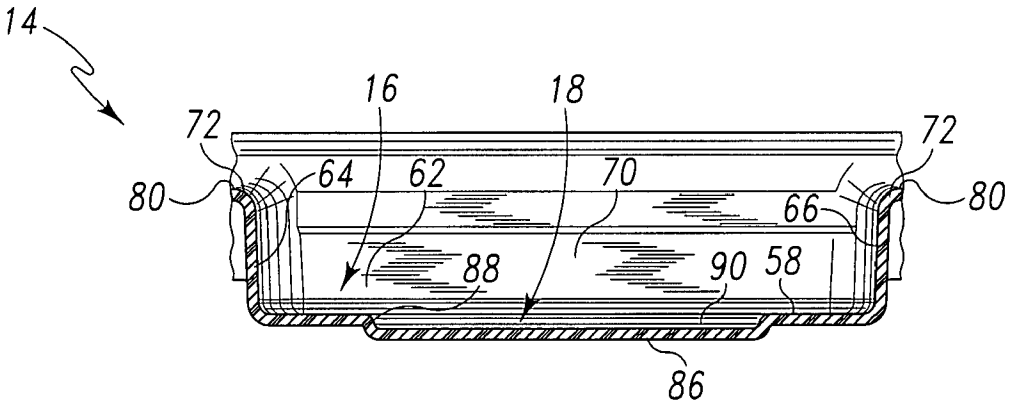
FIG. 6 is a sectional view taken along lines 6—6 of FIG. 5.

Third and fourth side wall portions 68, 70 are parallel to one another and are coupled to and extend in generally perpendicular relation to first and second side wall portions 64, 66, as shown, for example, in FIG. 5. First and second side wall portions 64, 66 extend farther away from square bottom wall 58 than third side wall portion 68 such that the top 78 of third side wall portion 68 is positioned between square bottom wall 58 and the tops 80 of first and second side wall portions 64, 66, as shown, for example, in FIG. 6.

Figure 7:
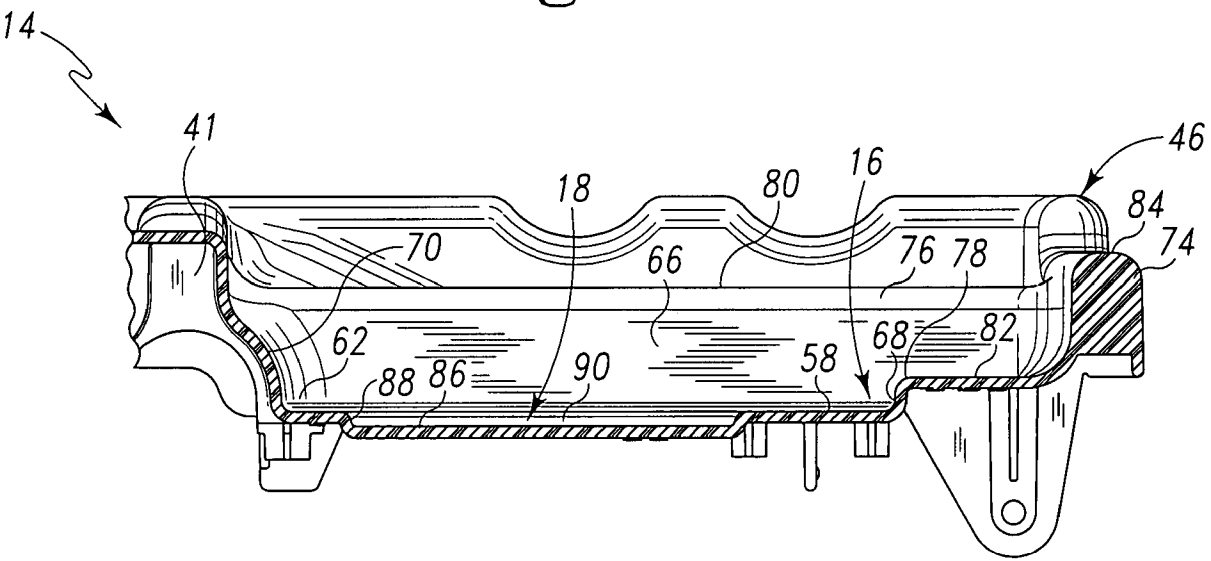
FIG. 7 is a sectional view taken along lines 7—7 of FIG. 5.

A shelf 82 connects third side wall portion 68 and rim rear portion 74, as shown, for example, in FIG. 7. Shelf 82 is coupled to top 78 of third side wall portion 68 and rim rear portion 74 at a location below the top 84 of rim rear portion 74.

Figure 12:
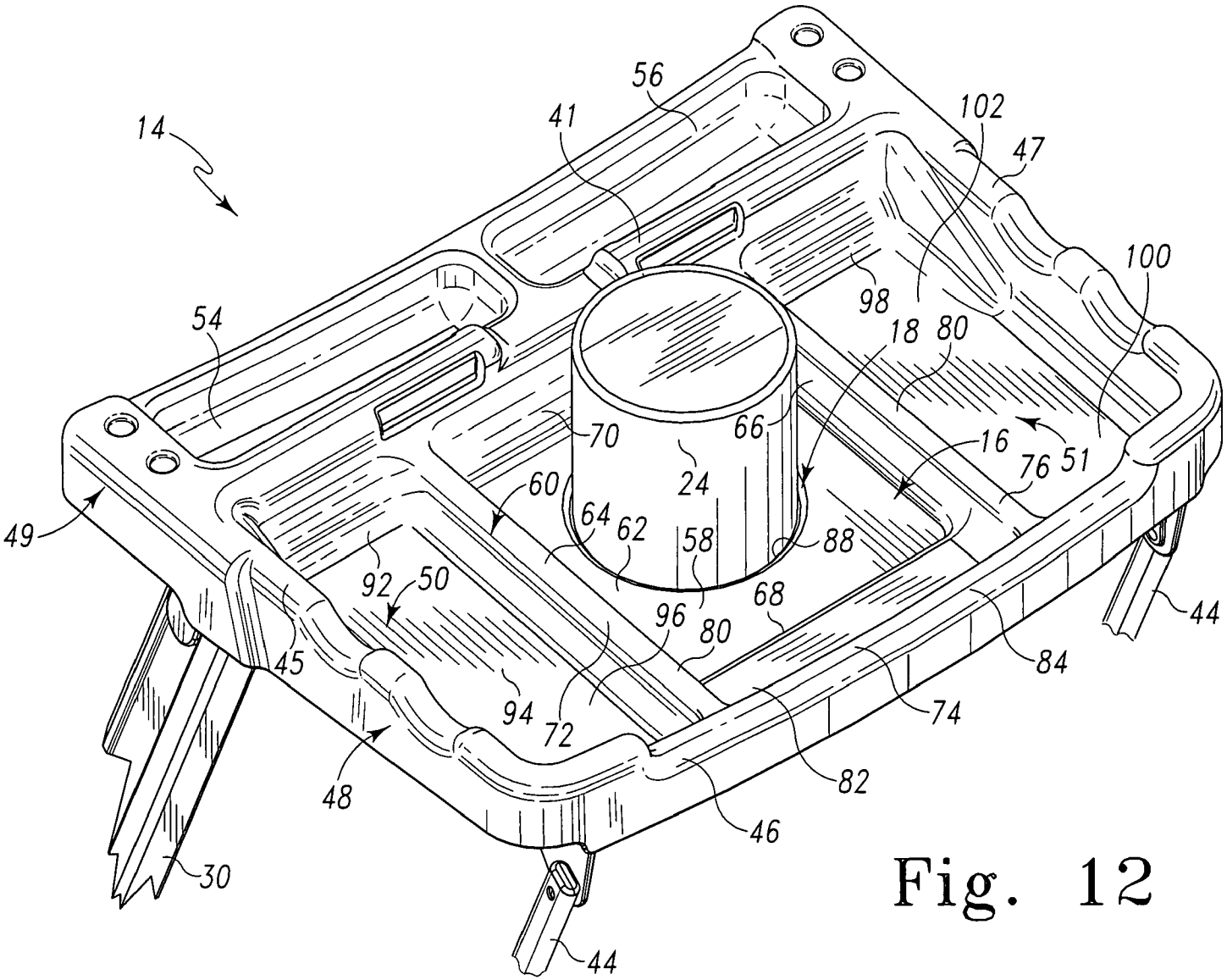
FIG. 12 is a perspective view showing the third paint container received in the smaller container receiver.
Figure 13:
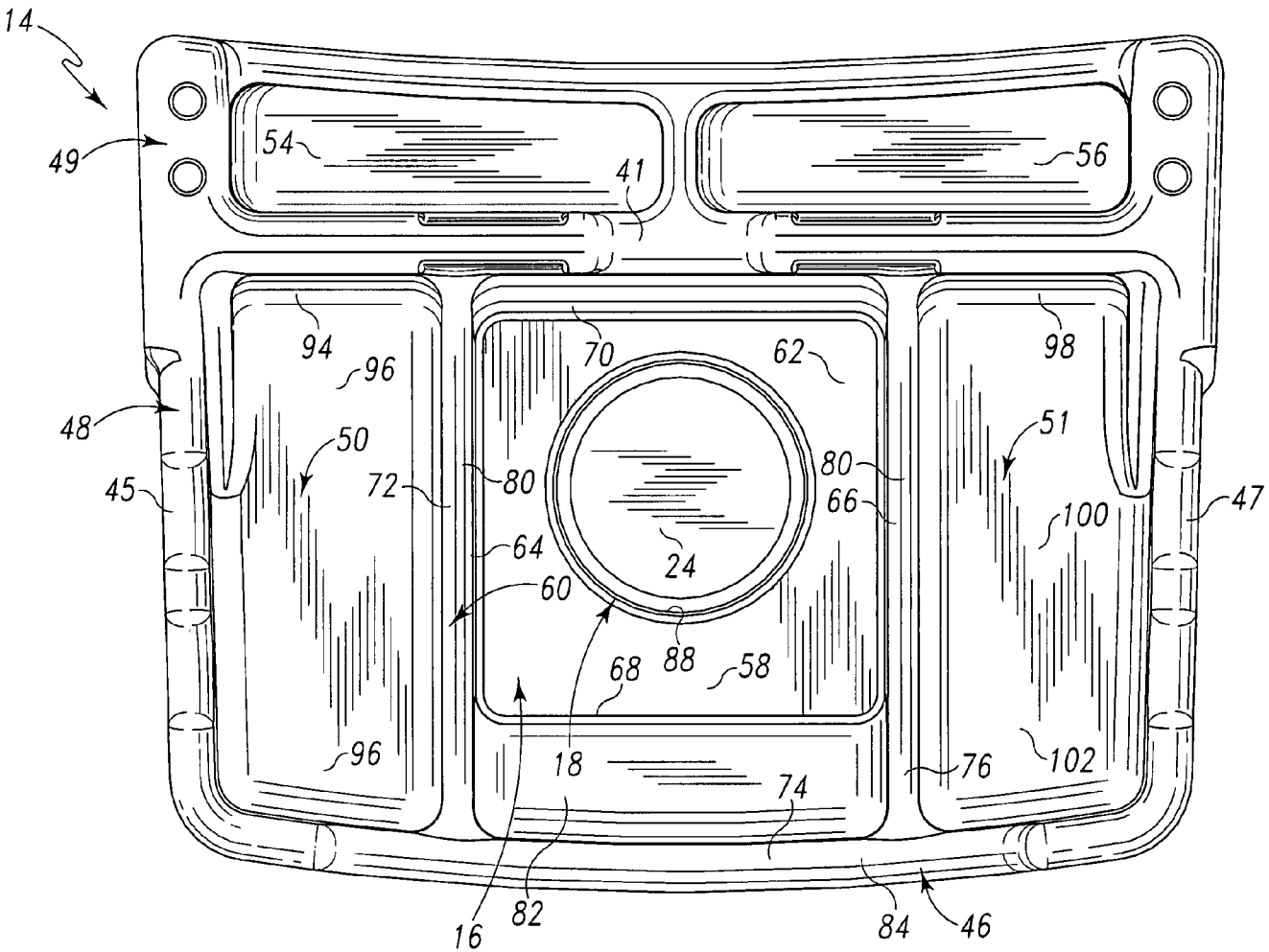
FIG. 13 is a top plan view showing the smaller container received in the smaller container receiver.

Smaller container receiver 18 is recessed from square bottom wall 58, as shown, for example, 6 and 7. Smaller container receiver 18 includes a circular bottom wall 86 and a circular side wall 88. Each wall 86, 88 has a generally circular shape. Circular side wall 88 connects circular bottom wall 86 and square bottom wall 58 and surrounds circular bottom wall 86 to retain a smaller container on circular bottom wall 86 in a smaller container recess 90 provided by circular bottom wall 86 and circular side wall 88. For example, circular side wall 88 is adapted to retain third paint container 24 on circular bottom wall 86 when third paint container 24 is positioned in smaller container recess 90, as shown, for example, in FIGS. 12 and 13. Circular side wall 88 provides a generally circular outer boundary that bounds smaller container recess 90.

Smaller container receiver 18 is spaced inwardly from square side wall 60, as shown, for example, in FIG. 5. Illustratively, container receivers 16, 18 are not concentric with one another. It is within the scope of this disclosure for container receivers 16, 18 to be concentric with one another. Bottom walls 58, 86 are flat and parallel to one another. Square bottom wall 58 surrounds circular side wall 88.

Figure 3:
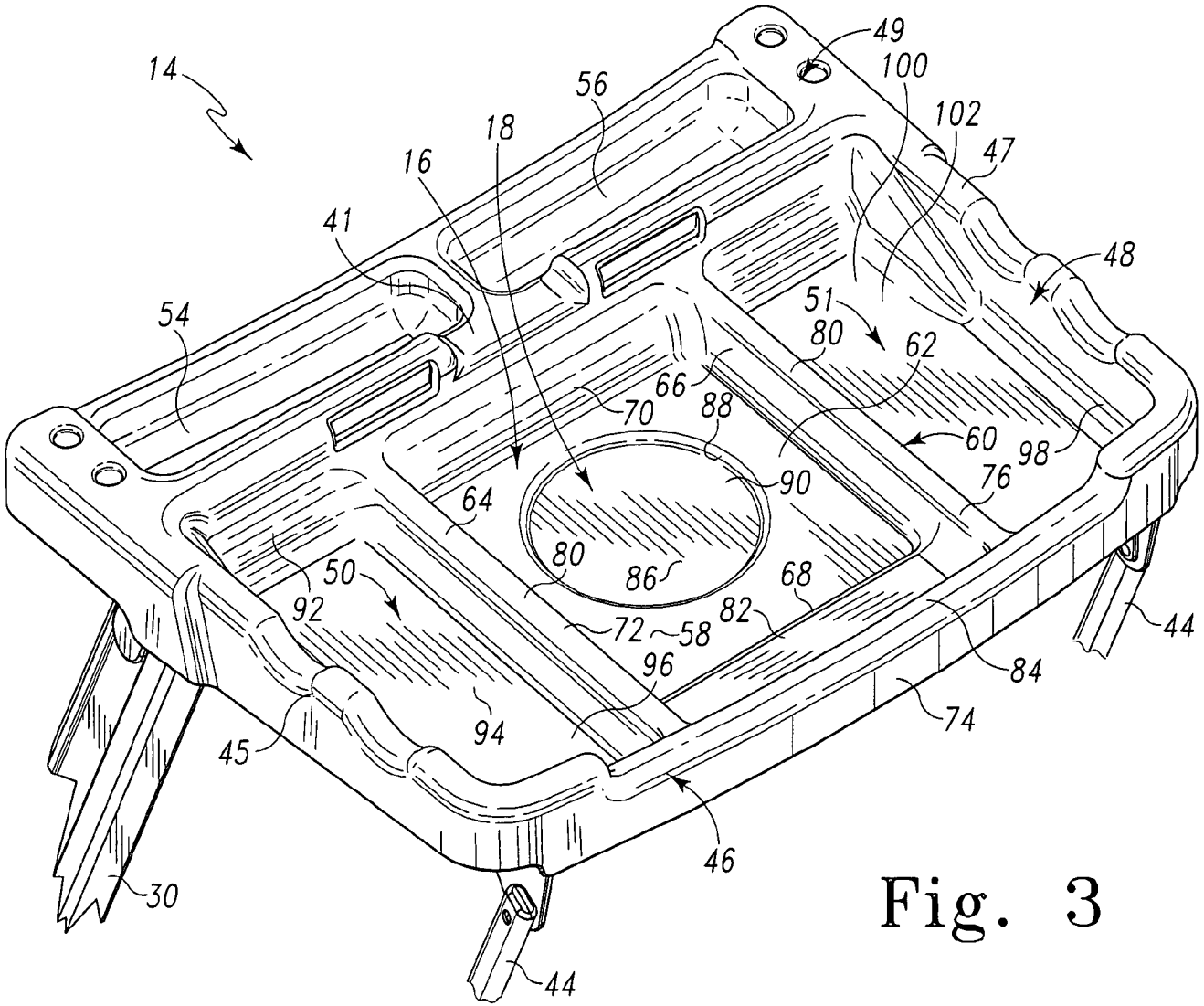
FIG. 3 is an enlarged top perspective view of the tray.

First side receiver 50 includes a side wall 92 and a bottom wall 94 coupled thereto, as shown, for example, in FIG. 3. Walls 92, 94 cooperate to provide a first side recess 96. First partition 41, second partition 72, rim rear portion 74, and first rim side portion 45 cooperate to provide side wall 92. First side recess 96 is located between first side wall portion 64 and first rim side portion 45.

Second side receiver 51 includes a side wall 98 and a bottom wall 100 coupled thereto, as shown, for example, in FIG. 3. Walls 98, 100 cooperate to provide a second side recess 102. First partition 41, third partition 76, rim rear portion 74, and second rim side portion 47 cooperate to provide side wall 98. Second side recess 102 is located between second side wall portion 66 and second rim side portion 47.

Larger and smaller container receivers 16, 18 provide means for receiving, one at a time, first paint container 20 having a generally square cylinder shape, second paint container 22 that has a generally circular cylinder shape and is configured to contain about the same volume of paint as first paint container 20, and third paint container 24 that has a generally circular cylinder shape and is smaller than second paint container 22.

The invention claimed is:

1. In combination, a step stool and paint container comprising a frame a tray coupled to the frame, the tray including means for receiving, one at a time, a first paint container having a generally square shape, a second paint container that has a generally circular cylinder shape and is configured to contain about the same volume of paint as the first paint container, and a third paint container that has a generally circular cylinder shape and is smaller than the second paint container, the receiving means including a larger container receiver and a smaller container receiver, the larger container receiver including a square bottom wall that has a generally square shape and perimeter and a square side wall that has a generally square shape and is coupled to and surrounds the square bottom wall to retain, one at a time, the first paint container and the second paint container on the square bottom wall in a larger container recess provided by the square bottom wall and the square side wall, the smaller container receiver being recessed from the square bottom wall and including a circular bottom wall that has a generally circular shape and a circular side wall that has a generally circular shape, connects the circular bottom wall and the square bottom wall, and surrounds the circular bottom wall to retain the third paint container on the circular bottom wall in a smaller container recess provided by the circular bottom wall and the circular side wall when the first paint container and the second paint container are not located in the larger container recess and a paint container having a generally square shape of substantially the same size perimeter as the perimeter of the square bottom wall.

2. The combination of claim 1, wherein the square side wall includes first, second, third, and fourth side wall portions coupled to the square bottom wall, the first and second side wall portions are parallel to one another, the third and fourth side wall portions are parallel to one another and are coupled to and extend in generally perpendicular relation to the first and second side wall portions, and the circular side wall is spaced inwardly apart from the first, second, third, and fourth side wall portions.

3. The combination of claim 1, wherein the first paint container is positioned on the square bottom wall.

4. The combination of claim 1, wherein the second paint container is positioned on the square bottom wall.

5. The combination of claim 1, wherein the third paint container is positioned on the circular bottom wall.

6. A step stool comprising a frame a tray coupled to the frame, the tray including means for receiving, one at a time, a first paint container having a generally square shape, a second paint container that has a generally circular cylinder shape and is configured to contain about the same volume of paint as the first paint container, and a third paint container that has a generally circular cylinder shape and is smaller than the second paint container, the receiving means including a larger container receiver and a smaller container receiver, the larger container receiver including a square bottom wall that has a generally square shape and a square side wall that has a generally square shape and is coupled to and surrounds the square bottom wall to retain, one at a time, the first paint container and the second paint container on the square bottom wall in a larger container recess provided by the square bottom wall and the square side wall, the smaller container receiver being recessed from the square bottom wall and including a circular bottom wall that has a generally circular shape and a circular side wall that has a generally circular shape, connects the circular bottom wall and the square bottom wall, and surrounds the circular bottom wall to retain the third paint container on the circular bottom wall in a smaller container recess provided by the circular bottom wall and the circular side wall when the first paint container and the second paint container are not located in the larger container recess wherein the square side wall includes first, second, third, and fourth side wall portions coupled to the square bottom wall, the first and second side wall portions are parallel to one another, the third and fourth side wall portions are parallel to one another and are coupled to and extend in generally perpendicular relation to the first and second side wall portions, and the circular side wall is spaced inwardly apart from the first, second, third, and fourth side wall portions, and wherein the tray includes a shelf that connects the third side wall portion and a rim included in the tray.

7. The step stool of claim 6, wherein the shelf is coupled to a top of the third side wall portion and to the rim at a location below the top of the rim.

8. A step stool comprising a frame a tray coupled to the frame, the tray including means for receiving, one at a time, a first paint container having a generally square shape, a second paint container that has a generally circular cylinder shape and is configured to contain about the same volume of paint as the first paint container, and a third paint container that has a generally circular cylinder shape and is smaller than the second paint container, the receiving means including a larger container receiver and a smaller container receiver, the larger container receiver including a square bottom wall that has a generally square shape and a square side wall that has a generally square shape and is coupled to and surrounds the square bottom wall to retain, one at a time, the first paint container and the second paint container on the square bottom wall in a larger container recess provided by the square bottom wall and the square side wall, the smaller container receiver being recessed from the square bottom wall and including a circular bottom wall that has a generally circular shape and a circular side wall that has a generally circular shape, connects the circular bottom wall and the square bottom wall, and surrounds the circular bottom wall to retain the third paint container on the circular bottom wall in a smaller container recess provided by the circular bottom wall and the circular side wall when the first paint container and the second paint container are not located in the larger container recess wherein the frame includes a cross member, the tray includes a partition coupled to the cross member for pivotable movement of the tray about the cross member, the partition partitions the tray into a rear portion and a front portion, the rear portion includes the larger container receiver, the smaller container receiver, and recessed first and second side receivers, the larger container receiver and the smaller container receiver are positioned between the first and second side receivers, the front portion includes recessed first and second front receivers, and the partition provides portions of each of the larger container receiver, the first and second side receivers, and the recessed first and second front receivers.

9. The step stool of claim 8, wherein the square side wall includes first, second, third, and fourth side wall portions, the first and second side wall portions are parallel to one another, the third and fourth side wall portions are parallel to one another and are coupled to and extend in generally perpendicular relation to the first and second side wall portions, and the partition includes the fourth side wall portion.

10. In combination, a step stool and paint container comprising a frame a tray coupled to the frame, the tray including a larger container receiver and a smaller container receiver, the larger container receiver including a square bottom wall that has a generally square shape and perimeter and a square side wall that has a generally square shape and is coupled to and surrounds the square bottom wall to retain a larger container on the square bottom wall in a larger container recess provided by the square bottom wall and the square side wall, the smaller container receiver being recessed from the square bottom wall and including a circular bottom wall that has a generally circular shape and a circular side wall that has a generally circular shape, connects the circular bottom wall and the square bottom wall, and surrounds the circular bottom wall to retain a smaller container on the circular bottom wall in a smaller container recess provided by the circular bottom wall and the circular side wall, and a paint container having a generally square shape of substantially the same size perimeter as the perimeter of the square bottom wall.

11. The combination of claim 10, wherein the square bottom wall and the circular bottom wall are parallel to one another.

12. The combination of claim 10, wherein the square bottom wall surrounds the circular side wall.

13. The combination of claim 10, wherein the larger container receiver and the smaller container receiver are not concentric with one another.

14. The combination of claim 10, the square side wall includes first, second, third, and fourth side wall portions coupled to the square bottom wall, the first and second side wall portions are parallel to one another, and the third and fourth side wall portions are parallel to one another and are coupled to and extend in generally perpendicular relation to the first and second side wall portions, and the circular side wall is spaced inwardly from the first, second, third, and fourth side wall portions.

15. A step stool comprising a frame a tray coupled to the frame, the tray including a larger container receiver and a smaller container receiver, the larger container receiver including a square bottom wall that has a generally square shape and a square side wall that has a generally square shape and is coupled to and surrounds the square bottom wall to retain a larger container on the square bottom wall in a larger container recess provided by the square bottom wall and the square side wall, the smaller container receiver being recessed from the square bottom wall and including a circular bottom wall that has a generally circular shape and a circular side wall that has a generally circular shape, connects the circular bottom wall and the square bottom wall, and surrounds the circular bottom wall to retain a smaller container on the circular bottom wall in a smaller container recess provided by the circular bottom wall and the circular side wall the square side wall includes first, second, third, and fourth side wall portions coupled to the square bottom wall, the first and second side wall portions are parallel to one another, and the third and fourth side wall portions are parallel to one another and are coupled to and extend in generally perpendicular relation to the first and second side wall portions, and the circular side wall is spaced inwardly from the first, second, third, and fourth side wall portions, and wherein the frame includes a cross member, the tray includes a first partition coupled to the cross member for pivotable movement of the tray about the cross member, a rim including spaced-apart first and second rim side portions and a rim rear portion connecting the first and second rim side portions, and spaced-apart second and third partitions extending from the first partition to the rim rear portion, the first partition extends from the first rim side portion to the second rim side portion, the first side wall portion is included in the second partition, the second side wall portion is included in the third partition, the fourth side wall portion is included in the first partition, the first partition, the second partition, the rim rear portion, and the first rim side portion cooperate to provide a side wall of a recessed first side receiver included in the tray, and the first partition, the third partition, the rim rear portion, and the second rim side portion cooperate to provide a side wall of a recessed second side receiver included in the tray.

16. The step stool of claim 15, wherein the first and second side wall portions extend farther away from the square bottom wall than the third side wall portion.

17. In combination, a step stool and paint container comprising a frame a tray coupled to the frame, the tray including a larger container receiver and a smaller container receiver recessed from and surrounded by the larger container receiver, the larger container receiver including a square outer boundary that has a generally square shape and perimeter and bounds a larger container recess formed in the larger container receiver to retain a larger container in the larger container recess, the smaller container receiver including a circular outer boundary that has a generally circular shape and bounds a smaller container recess formed in the smaller container receiver to retain a smaller container in the smaller container recess, and a paint container having a generally square shape of substantially the same size perimeter as the perimeter of the square bottom wall.

18. The combination of claim 17, wherein the larger container receiver includes a flat square bottom wall that has a generally square shape, the square outer boundary is a square side wall that includes first, second, third, and fourth side wall portions coupled to the square bottom wall, the first and second side wall portions are parallel to one another, and the third and fourth side wall portions are parallel to one another and are coupled to and extend in generally perpendicular relation to the first and second side wall portions.

19. The combination of claim 18, wherein the smaller container receiver includes a flat circular bottom wall that is generally circular and spaced apart from the square bottom wall and the circular outer boundary is a circular side wall that connects the circular bottom wall and the square bottom wall and is spaced inwardly apart from the first, second, third, and fourth side wall portions.

20. The combination of claim 17, wherein the tray includes a first side receiver and a second side receiver, the first side receiver is formed to a first side recess located between the first side wall portion and a rim included in the tray, and the second side receiver is formed to include a second side recess located between the second side wall portion and the rim.

21. The combination of claim 17, wherein the tray includes recessed first and second side receivers and the larger container receiver and the smaller container receiver are positioned between the first and second side receivers.

22. A step stool comprising a frame a tray coupled to the frame, the tray including a larger container receiver and a smaller container receiver recessed from and surrounded by the larger container receiver, the larger container receiver including a square outer boundary that has a generally square shape and bounds a larger container recess formed in the larger container receiver to retain a larger container in the larger container recess, the smaller container receiver including a circular outer boundary that has a generally circular shape and bounds a smaller container recess formed in the smaller container receiver to retain a smaller container in the smaller container recess wherein the larger container receiver includes a flat square bottom wall that has a generally square shape, the square outer boundary is a square side wall that includes first, second, third, and fourth side wall portions coupled to the square bottom wall, the first and second side wall portions are parallel to one another, and the third and fourth side wall portions are parallel to one another and are coupled to and extend in generally perpendicular relation to the first and second side wall portions wherein the smaller container receiver includes a flat circular bottom wall that is generally circular and spaced apart from the square bottom wall and the circular outer boundary is a circular side wall that connects the circular bottom wall and the square bottom wall and is spaced inwardly apart from the first, second, third, and fourth side wall portions, and wherein the tray includes a rim and a shelf that is coupled to the rim and the top of the third side wall portion and the top of the third side wall portion is positioned between the square bottom wall and the tops of the first and second side wall portions.

* * * * *